United States Patent [19]

Barr

[11] 4,223,950

[45] Sep. 23, 1980

[54] LONGWALL CUTTING MACHINES WITH DRUM MOVED BY PLURAL POWER MEANS

[75] Inventor: Thomas G. Barr, Malvern, England

[73] Assignee: Dowty Meco Limited, Worcester, England

[21] Appl. No.: 9,811

[22] Filed: Feb. 6, 1979

[30] Foreign Application Priority Data

Feb. 15, 1978 [GB] United Kingdom ..... 5948/78

[51] Int. Cl.[2] ..... E21C 27/24

[52] U.S. Cl. ..... 299/54; 299/89

[58] Field of Search ..... 299/42, 43, 53, 54, 299/51, 52

[56] References Cited

U.S. PATENT DOCUMENTS 3,418,023 12/1968 Webster ..... 299/51 X 4,027,918 6/1977 Hujimori ..... 299/53

FOREIGN PATENT DOCUMENTS 2425828 11/1975 Fed. Rep. of Germany ..... 299/42

*Primary Examiner*—Ernest R. Purser

*Attorney, Agent, or Firm*—Young & Thompson

[57] ABSTRACT

This invention relates to a mineral-cutting machine, the overall length of which can be substantially reduced, comprising a body and a ranging arm mounted for pivotal movement with respect to the body. A cutting device is supported on the ranging arm for rotation about an axis extending away from the ranging arm in a direction transverse to the intended direction of movement of the machine during a cutting operation. The cutting device is normally in a position at least partly beyond an end of the body during a cutting operation, and means are provided for moving the cutting device from said normal position at least partly beyond an end of the body to a position where it is at least substantially wholly alongside of the body.

9 Claims, 3 Drawing Figures

LONGWALL CUTTING MACHINES WITH DRUM MOVED BY PLURAL POWER MEANS

This invention relates to mineral-cutting machines such as, for example, coal-cutting machines.

Such mineral-cutting machines include at least one cutting device which may be of rotary type and which can be so positioned that when driven, and during movement of the machine along the mineral face, it cuts into the mineral seam.

In known cutting machines cutting devices are so arranged upon the body of the machine that the overall length of the machine is greater than desirable in the confines of a mine and as a result the machine is difficult to manoeuvre at certain positions at the mineral face.

The invention as claimed is intended to provide a remedy. It solves the problem of how to design a mineral-cutting machine so that its overall length can be substantially reduced, resulting in a machine which is more easily manoeuvred at said certain positions.

A mineral-cutting machine in accordance with the invention comprises a body, a ranging arm mounted for pivotal movement with respect to the body, a cutting device supported on the ranging arm for rotation about an axis extending away from the ranging arm in a direction transverse to the intended direction of movement of the machine during a cutting operation, said cutting device being normally in a position at least partly beyond an end of the body during a cutting operation, and means for moving the cutting device from said normal position at least partly beyond an end of the body to a position where it is at least substantially wholly alongside of the body.

The machine may be of double-ended form in that a said ranging arm, each with an associated said cutting device, is provided at each end of said body, one cutting device being, in its normal position, at least partly beyond one end of said body and the other cutting device being, in its normal position, at least partly beyond the other end of the body.

Figure 1:
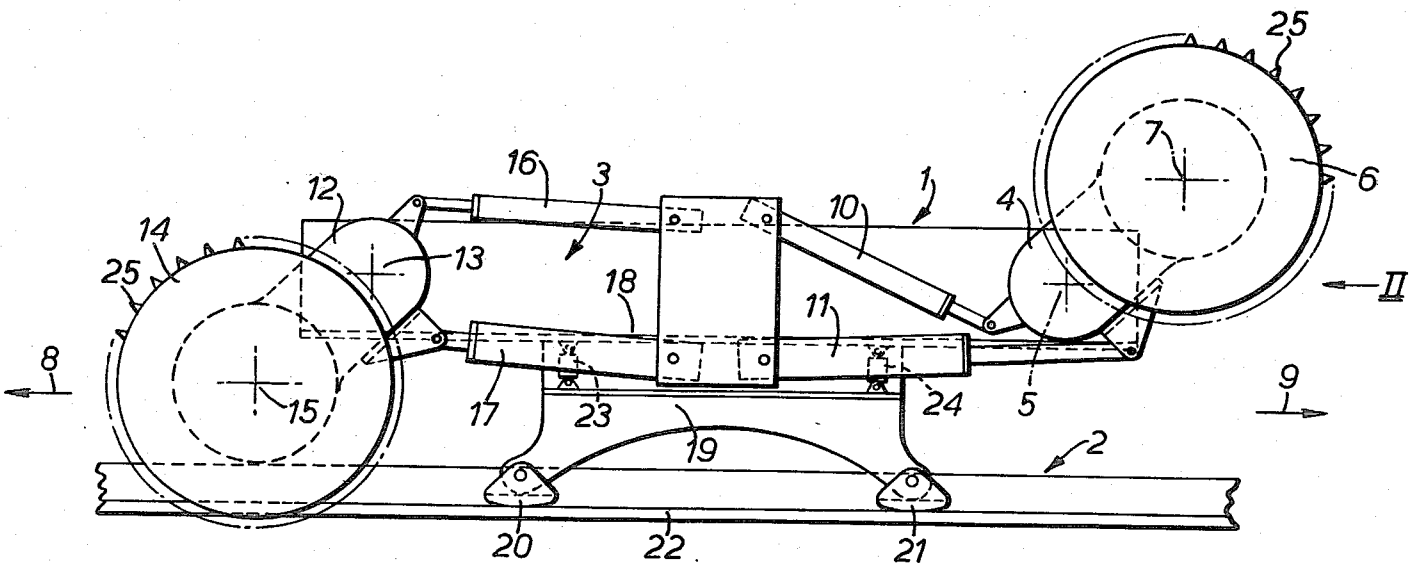
Figure 2:
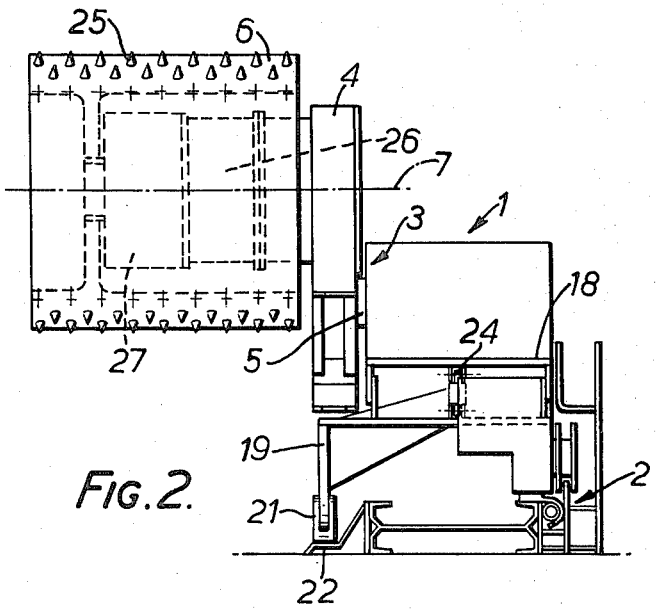
Figure 3:
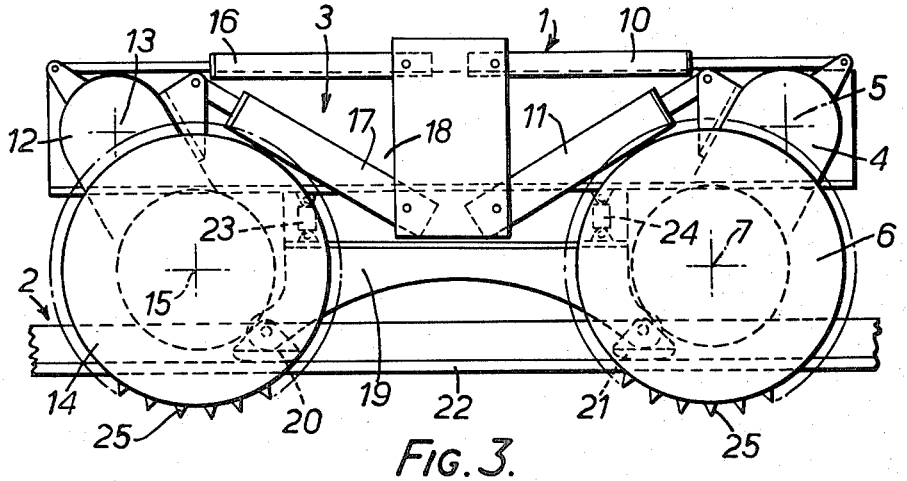

One way of carrying out the invention is described in detail below with reference to drawings which illustrate only one specific embodiment, in which:

FIG. 1 is a side elevation of a mineral-cutting machine in accordance with the invention, FIG. 2 is a view taken in the direction of arrow II on FIG. 1, but omitting device 14, and, FIG. 3 is a side elevation of the mineral-cutting machine of FIGS. 1 and 2 with its cutting devices disposed substantially wholly alongside of the body of the machine.

The figures show a machine 1 intended to cut coal from a coal seam in a mine and mounted for travel upon a conveyor 2 which runs along the length of the coal face. In its basic design the machine 1 comprises a body 3, a ranging arm 4 mounted at 5 for pivotal movement with respect to the body and a cutting device 6 which is supported on the ranging arm for rotation about an axis 7 extending away from the ranging arm in a direction transverse to the intended direction of movement, indicated by the arrow 8 or the arrow 9 in FIG. 1, of the machine during a coal-cutting operation.

In accordance with the invention, the cutting device 6 is normally in a position at least partly beyond an end of the body 3 during a cutting operation, and means 10, 11 are provided for moving the cutting device from said normal position at least partly beyond an end of the body to a position where it is at least substantially wholly alongside of the body.

In this embodiment the machine 1 is of double-ended form in that at its other end it has a further ranging arm 12 mounted at 13 for pivotal movement with respect to the body 3, a cutting device 14 being supported on this ranging arm for rotation about an axis 15 parallel with the axis 7. Thus in their normal positions as shown in FIG. 1 the cutting device 6 is partly beyond the right-hand end of the body 3 and the cutting device 14 is partly beyond the left-hand end of the body.

The means 10, 11 for bringing the cutting device 6 at least substantially wholly alongside of said body, as well as similar means 16, 17 for bringing the cutting device 14 at least substantially wholly alongside of said body, are all hydraulically-operable. As shown in FIGS. 1 and 3, these means 10, 11, 16, 17 comprise telescopic piston-and-cylinder devices, the cylinder of each of which is pivotally connected at a respective position on the body 3, and the piston rod of each of which is pivotally connected at a respective position on its associated ranging arm 4, 12.

In operation of the machine 1 with the ranging arms 4 and 12 and the cutting devices 6 and 14 in the positions shown in FIG. 1, the cutting device 6 cuts an upper part of the coal seam as the machine moves from one end of the coal face to the other, and during such movement the other cutting device 14 simultaneously cuts a lower part of the coal seam.

In order to move the ranging arms 4 and 12 and the cutting devices 6 and 14 to the positions shown in FIG. 3 in which they are at least substantially wholly alongside of the body 3, the piston-and-cylinder devices 10, 11, 16 and 17 are operated as necessary by the adjustment of suitable hydraulic valves (not shown) associated therewith.

The body 3 comprises an upper portion 18 upon which the ranging arms 4 and 12 and the piston-and-cylinder devices are mounted and a lower portion 19 which includes shoe elements 20 and 21 which slidingly engage a track portion 22 of the conveyor 2.

Means in the form of hydaulic jacks 23 and 24 are provided for elevating the upper portion 18 with respect to the lower portion 19, and thus with respect to the floor of the mine over which the machine 1 is movable, in order to afford sufficient clearance between the cutting devices 6, 14 and the floor to enable the devices 10, 11, 16 and 17 to bring the cutting devices substantially wholly alongside of the body 3.

Each cutting device 6 and 14 is in the form of a drum fitted with picks 25 of suitable shape on its exterior surface for efficient cutting of the coal with which the device is brought into contact. Also, each cutting device is provided with a respective driving motor 26 and reduction gearing 27 which are wholly contained therein. As a result of this the overall length of the machine is reduced because the body 3 is not then required to carry or to contain the driving motor and part of the transmission between the driving motor and the cutting device. Further, the disposition of mechanical transmission means within the respective ranging arm is avoided.

Although in the embodiment above-described with reference to the drawings piston-and-cylinder devices are used to bring the cutting devices at least substantially wholly alongside of said body, in other embodiments of the invention this is achieved by rack-and-pinion means, by means which move both the respective ranging arm and the cutting device bodily axially of the body 3, or, by means which move the cutting device axially along its respective ranging arm.

In other embodiments of the invention the or each ranging arm may comprise two parts, one pivoted to the other, so that the arm can be bent in order to bring its cutting device at least substantially wholly alongisde of the body, or, alternatively and particularly when the driving motor for the or each cutting device is at least substantially wholly contained within the device, the arm may comprise two parts, one telescoping in the other.

In further embodiments of the invention the or each cutting device may be movable, by suitable means, bodily away from the body of the mineral-cutting machine and from its respective ranging arm in a direction transverse to the intended direction of movement of the machine along the mineral face. In yet other embodiments of the invention the or each cutting device and also its respective ranging arm may together be movable, by suitable means, bodily away from the body of the machine in a direction transverse to the intended direction of movement of the machine along the mineral face.

In both cases it is intended that such transverse movement is effected when the machine is at the ends of the mineral face and in order to provide advantages in the particular mode of operation of the machine.

Such transverse movement may be effected by fluid-pressure-operable means, by screw-threaded devices, by cam devices, or by any other suitable means operable either between the ranging arm and the cutting device, or, between the body of the machine and the ranging arm, as the case may be.

The provision in the mineral-cutting machines for effecting such transverse movement obviates the need for bodily transverse movement of the entire machine as has been the case hitherto in order to achieve the desired particular mode of machine operation when at the ends of the mineral face. Such bodily transverse movement of the entire machine necessitated modification of the machine tracks and guides, this being costly as well as a hindrance to operations.

Since in the above-mentioned embodiments where the or each cutting device, or alternatively the or each cutting device together with its ranging arm, are movable transversely with respect to the body of the machine the gearing is again disposed wholly within the respective cutting device and the driving motor is at least substantially wholly housed within the respective cutting device, there is considerably less mechanical complexity involved in effecting such transverse movement than would otherwise have been the case with a motor housed upon or in the machine body and with gearing, for transmitting drive from the motor to the cutting device, housed at least in part within the ranging arm.

I claim:

1. A mineral-cutting machine comprising a body, a ranging arm mounted for pivotal movement with respect to the body, a cutting device supported on the ranging arm for rotation about an axis extending away from the ranging arm in a direction transverse to the intended direction of movement of the machine during a cutting operation, said cutting device being normally in a position at least partly beyond an end of the body during a cutting operation, and means, for moving said ranging arm, comprising first and second power-operated devices each of which is connected at one part thereof to said body at a respective position thereon, and each being connected at another part thereof to said ranging arm at a respective position thereon, said positions being so relatively disposed that said first and second devices, when operated, are together capable of moving the cutting device from said normal position at least partly beyond an end of the body to a position where it is at least substantially wholly alongside of said body.

2. A machine as claimed in claim 1, wherein a said ranging arm, each with an associated cutting device, is provided at each end of said body, one cutting device being, in its normal position, at least partly beyond one end of said body and the other cutting device being, in its normal position, at least partly beyond the other end of the body.

3. A machine as claimed in claim 1, wherein said first and second devices are fluid-pressure-operable.

4. A machine as claimed in claim 3, wherein said fluid-pressure-operable devices are of piston-and-cylinder type.

5. A machine as claimed in claim 1, wherein means are provided for elevating at least a part of said body with respect to the floor over which said machine is movable in order to allow said cutting device to be brought substantially wholly alongside of the body.

6. A machine as claimed in claim 1, wherein said cutting device comprises a drum fitted with picks.

7. A machine as claimed in claim 1, wherein said cutting device is movable by suitable means bodily away from said body and from said ranging arm in a direction transverse to said intended direction of movement of said machine.

8. A machine as claimed in claim 1, wherein said cutting device and said ranging arm are together movable by suitable means bodily away from said body in a direction transverse to said intended direction of movement of said machine.

9. A machine as claimed in claim 8, wherein the transverse movement is effected by fluid-pressure-operable means.

* * * * *